United States Patent [19]

Paranay et al.

[11] 4,257,460

[45] Mar. 24, 1981

[54] WATER GUN

[76] Inventors: Bruce J. Paranay, 10401 Encino Ave., Granada Hills, Calif. 91344; Melvin D. Michael, 4312 1/2 Whitsett Ave., Studio City, Calif. 91604

[21] Appl. No.: 47,879

[22] Filed: Jun. 12, 1979

[51] Int. Cl.[3] ..... B65B 3/16

[52] U.S. Cl. ..... 141/26; 141/311 R; 46/88; 222/210

[58] Field of Search ..... 141/2, 18, 25, 26, 360–362, 141/22, 23, 24, 21, 348, 349, 351, 352, 363, 114, 353, 311 R; 222/79, 174, 189, 105, 210, 212–215, 386.5, 469, 517, 78; 137/519; 251/321, 325, 353; 273/86 R, 105.4, 106 R; 46/76 A, 88

[56] References Cited

U.S. PATENT DOCUMENTS

| | | | |
|---|---|---|---|
| 1,392,861 | 10/1921 | Tabacco | 46/88 |
| 3,025,634 | 3/1962 | Barricks | 46/88 |
| 4,134,228 | 1/1979 | Ortiz | 46/88 |
| 4,135,559 | 1/1979 | Barnby | 141/18 |

*Primary Examiner*—Houston S. Bell, Jr.
*Attorney, Agent, or Firm*—Roger A. Marrs

[57] ABSTRACT

A novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body and a trigger mechanism may be employed for selectively releasing the pressurized water within the storage compartment.

8 Claims, 4 Drawing Figures

WATER GUN

BACKGROUND OF THE INVENTION

1. Field of the Invention

This invention relates to amusement devices of the water or "squirt" gun type and more particularly to a novel water gun which may be loaded under pressure and which includes a pressurized water storage compartment for discharging the water therefrom in response to release of pressure.

2. Description of the Prior Art

In the past, amusement devices such as water guns have been provided which are carried by the user and which are hand held for operation. Normally, the device takes the form of a gun which includes a water reservoir and a trigger operated pump for forceably urging the water from the reservoir through a discharge orifice or nozzle. Usually, the reservoir is connected to the nozzle via a series of tubes which are interconnected via the pump.

Although such a device is operable and useful for its intended purpose, the prior gun requires extensive finger pressure of operation via the trigger mechanism in order to discharge a stream of water for a considerable distance. In some instances, greater distances can be gained by rapidly exerting the finger mechanism so that an accumulated pump creates sufficient pressure enabling the water to be discharged at a distance further than normal. Difficulties have been encountered with such conventional devices since they do include pumps which are expensive and which have a tendency to malfunction. Therefore, such prior art devices are somewhat limited in their use and operation. Such device do not lend themselves for shooting or squirting the water for substantial distances.

Therefore, a long standing need has existed to provide an amusement device which may be readily loaded under pressure with water and which may be selectively discharged under pressure avoiding the use or employment of a pump.

SUMMARY OF THE INVENTION

Accordingly, the above problems and difficulties are obviated by the present invention which provides a novel water gun device comprising an elongated body having a central open-ended bore terminating in a nozzle at one end and terminating at its opposite end in an attachment means for an expandable storage compartment. In one form of the invention, the expandable storage compartment comprises an expandable tubing held in fluid communication with the central bore of the body so that pressurized water may be introduced thereto and may be discharged therethrough when the expandable member or tube deflates or collapses.

Discharge of the pressurized contents of the expandable member may be under selective control by a trigger mechanism via simple valving or the like. Also, means may be provided for introducing the pressurized water to the inflatable bladder or tube member which may take the form of a pressurized hose either directly in contact with the nozzle or by means of a threaded adapter which fits into a standard hose coupling having a filling orifice in contact with the bore at the nozzle end of the body.

Therefore, it is among the primary objects of the present invention to provide a novel water gun device which is readily operated to discharge a pressurized stream via the collapsing of an expandable tube or bladder serving as a storage compartment for the water.

Another object of the present invention is to provide a novel water gun having a pressurized storage compartment which expands when storing the water and which collapses to forceably urge the water through a discharge orifice so that the water shoots or squirts a considerable distance.

Still a further object of the present invention is to provide a novel gun having a trigger mechanism for selectively releasing pressurized water from a storage bladder so that the water is discharged a considerable distance.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings, in which:

DESCRIPTION OF THE PREFERRED EMBODIMENT

Figure 1:
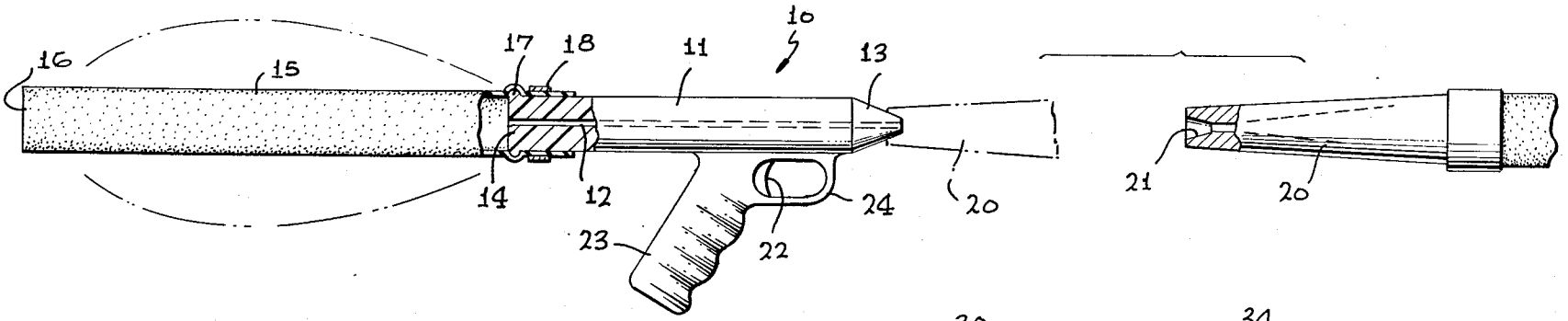
FIG. 1 is a side elevational view, partly in section, of the novel water gun device of the present invention.

Referring to FIG. 1, the novel water gun device of the present invention is illustrated in the general direction of arrow 10 and includes an elongated body 11 having an open-ended central bore 12 extending therethrough so as to terminate at a discharge nozzle or end 13 and at its opposite end in a storage compartment attaching end indicated by numeral 14. The storage compartment is indicated by numeral 15 which is characterized as an elongated expandable sleeve having its free end 16 closed while its opposite end is expanded over an annular bead 17 to be secured by a releaseable clamp 18. The interior of the expandable bladder or tube 15 is in fluid communication with the terminating end of the central bore 12 at end 14 so that fluid, such as water, may be introduced through the nozzle 13 for pressurized introduction to the storage bladder 15.

To illustrate introduction of the pressurized water FIG. 1 further illustrates a high pressure nozzle 20 having a conical discharge duct 21 carried in the extreme end of the nozzle which insertably receives the tapered nozzle 13 of the body 11. Insertion is illustrated in broken lines so that the water from the pressurized nozzle 20 is directly introduced to the open end of the central bore and introduced into the interior of the tube on bladder 15. Since the tube or bladder 15 is blocked by its end 16, the material expands to the position shown in broken lines under pressure of the water from the high pressure nozzle 20.

Once the tube or bladder 15 has been expanded under the force of the pressurized water, the nozzle 20 may be rapidly removed followed by the positioning of the users finger over the discharge orifice in the nozzle 13. When the user desires to shoot or fire the water gun, he may remove his finger for a brief period of time so that a pressurized spurt or stream of water will be discharged. However, a more sophisticated device may be provided by the incorporation of a trigger mechanism therein which is indicated by numeral 22 slideably carried on a handle 23. A conventional trigger guard 24 completes the assembly.

Figure 2:
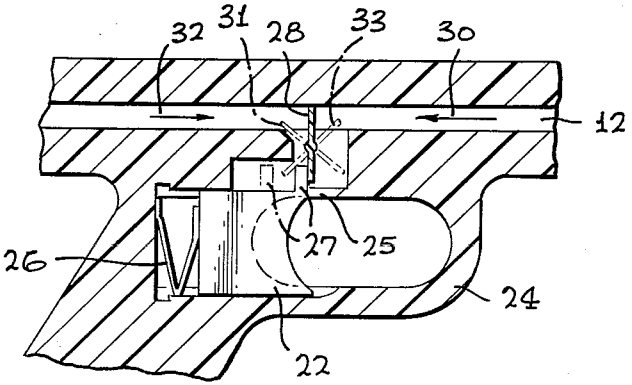
FIG. 2 is a fragmentary cross-sectional view of the trigger mechanism employed in the embodiment shown in FIG. 1.

As shown more clearly in FIG. 2, the trigger mechanism includes the trigger 22 slideably carried on the body and being spring biased into the position shown in broken lines against a shoulder 25 by a leaf spring 26. When the trigger 22 is in this position, an element 27 carried on the trigger 22 prohibits a pivotal paddle or closure means 28 from moving so that one end of the paddle closes the central bore 12. However, when the trigger 22 is moved rearwardly away from the guard 24 so that the element of 27 resides in the position shown in broken lines, the paddle or closure means 28 is free to rotate in either direction to either of the two positions shown in broken lines. Therefore, when the trigger is moved against the spring bias of spring 26 to its rearward position, pressurized water may be introduced to the storage bladder 15 in the direction of arrow 30 and the closure means 28 will be in the broken line position represented by the numeral 31. However, when the trigger is in the rearmost position as previously described and the nozzle 13 is opened, the pressurized water contained within the expandable storage compartment or bladder 15 will move in the direction of arrow 32 so that the closure means will assume the position in broken lines as indicated by numeral 33. When the closure means is in either position 31 or 33, no blockage of the central bore occurs.

Figure 4:
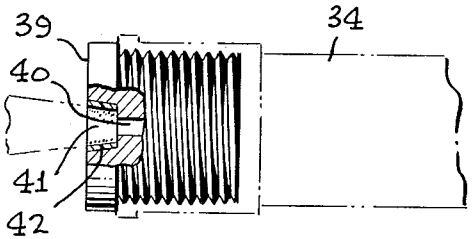
FIG. 4 is an enlarged elevational view, partly in section, of the novel adapter used in FIG. 3 for accomodating loading of the water gun under pressure.
Figure 3:
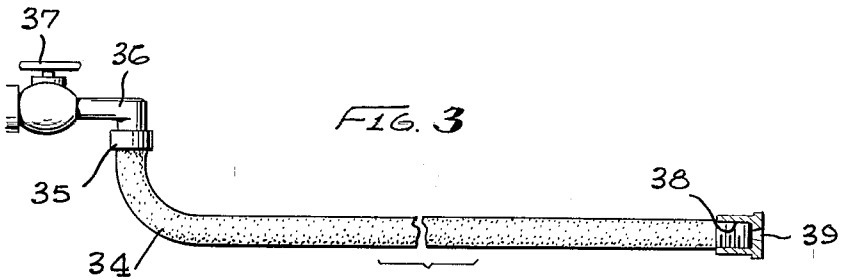
FIG. 3 is a side elevational view of a novel means for loading the water gun or the storage compartment thereof under pressure.

FIGS. 3 and 4 show an alternate means for introducing pressurized water to the central bore 12. FIG. 3 illustrates a conventional water hose 34 which is connected at one end by a suitable coupling 35 to a conventional faucet 36 having a shut off valve 37. The opposite end of the hose is provided with a conventional threaded coupling 38 having internal threads for receiving a conventional discharge nozzle. However, the present invention includes an adapter which is illustrated by numeral 39 that threadably engages with the coupling 38 and includes a discharge bore for receiving the nozzle 13.

As shown more clearly in FIG. 4, the adapter 39 is provided with external threads engageable with the internal threads of coupling 38. The insert adapter 39 includes a central bore 40 that communicates with a tapered orifice 41 having a rubber or seal 42 held therein for receiving the nozzle 13. In this manner, the central bore 12 is aligned with the bore 40 so that the pressurized water is introduced to the bladder.

Therefore, it can be seen that the novel water gun device of the present invention provides a means for storing water under pressure and means for discharging the water for great distances when released. Means are provided for automatically releasing the water under pressure when desired which may take the form of the users finger placed over the orifice of the nozzle 13 or which may take the form of a closure 28 operated by a spring biased trigger mechanism 22. Preferably, the storage compartment tube or bladder 15 is composed of a hard rubber material which expands upon the flow of pressurized water into the interior thereof. The closure at the free end on the tube or bladder may be provided by heat seal procedures or by suitably clamping or plugging the end of the tube. Preferably, the wall thickness of the tube or bladder is roughly 1/16 of an inch to ¼ of an inch and the length of tubing is approximately one to two feet. Therefore, the tube or bladder 15 is thick-walled as opposed to a thinwall such as a balloon or other readily flexible bladder.

While particular embodiments of the present invention have been shown and described, it will be obvious to those skilled in the art that changes and modifications may be made without departing from this invention in its broader aspects and, therefore, the aim in the appended claims is to cover all such changes and modifications as fall with the true spirit and scope of this invention.

What is claimed is:

1. A water gun device comprising:

an elongated body having a central bore extending therethrough opening at one end in a nozzle and opening at its opposite end in an attachment end of said body:

an expandable bladder having an opening for receiving a pressurized fluid releasably carried on said attachment end of said elongated body in fluid communication with said central bore;

means for detachably coupling said expandable bladder to said attachment end of said elongated body; and said nozzle being tapered from the exterior diameter of said body towards said central bore opening associated therewith;

said attachment end of said elongated body includes an annular bead over which said bladder is stretched in gripping relationship;

said coupling means is a clamp adapted to encircle said bladder gripping said attachment end.

2. The invention as defined in claim 1 wherein:

said elongated body includes a handle grip downwardly depending approximately mid-way between its opposite ends.

3. The invention as defined in claim 2 including:

trigger mechanism operably mounted on said handle and adapted to selectively block said central bore to prohibit fluid flow therethrough.

4. The invention as defined in claim 3 wherein:

said trigger mechanism includes a spring biased trigger and a rotatable closure member;

said trigger normally biased to position said closure member to block said central bore.

5. The invention as defined in claim 4 including:

means for introducing pressurized water to said expandable bladder via said central bore comprising:

a source of pressurized water;

a flexible hose coupled to said water source;

a nozzle carried on the end of said hose opposite to its end coupled to said water source;

said nozzle having a reduced opening for insertably receiving said tapered nozzle whereby pressurized water is introduced into said central bore.

6. The invention as defined in claim 5 wherein:

said pressurized water introducing means comprising a threadable insert having a tapered opening for receiving said tapered nozzle; and an annular seal disposed between said tapered nozzle and said tapered opening to prevent loss of pressurized water.

7. The invention as defined in claim 6 wherein:

said expandable bladder is thick-walled and is composed of a hard rubber-like substance resistive, but yieldable to said pressurized water.

8. The invention as defined in claim 7 wherein:

said bladder and said trigger mechanism cooperate to introduce said pressurized water to said bladder to effect expanding thereof and to exhaust said bladder of said pressurized water to collapse said bladder subsequent to expansion.

* * * * *